US010986448B2

(12) United States Patent
Kim et al.

(10) Patent No.: US 10,986,448 B2
(45) Date of Patent: Apr. 20, 2021

(54) SOUND VIBRATION ACTUATOR

(71) Applicant: Mplus CO., LTD., Suwon-si (KR)

(72) Inventors: Yong Jin Kim, Suwon-si (KR); Jun Kun Choi, Suwon-si (KR); Yeon Ho Son, Suwon-si (KR); Yong Tae Kim, Suwon-si (KR); Dong Su Moon, Suwon-si (KR); Seok Jun Park, Suwon-si (KR); Tae Hoon Lee, Suwon-si (KR)

(73) Assignee: MPLUS CO., LTD., Suwon-si (KR)

( * ) Notice: Subject to any disclaimer, the term of this patent is extended or adjusted under 35 U.S.C. 154(b) by 0 days.

(21) Appl. No.: 16/704,059

(22) Filed: Dec. 5, 2019

(65) Prior Publication Data

US 2020/0296516 A1 Sep. 17, 2020

(30) Foreign Application Priority Data

Oct. 26, 2018 (KR) ..... 10-2018-0128758

(51) Int. Cl.

| | |
|---|---|
| ***H04R 9/06*** | (2006.01) |
| ***B06B 1/04*** | (2006.01) |
| ***H04R 1/02*** | (2006.01) |
| ***H04R 9/02*** | (2006.01) |

(52) U.S. Cl.

CPC ..... *H04R 9/06* (2013.01); *B06B 1/045* (2013.01); *H04R 1/025* (2013.01); *H04R 9/025* (2013.01)

(58) Field of Classification Search

CPC ..... H04R 9/06; H04R 1/025; H04R 9/025

USPC ..... 381/400

See application file for complete search history.

(56) References Cited

U.S. PATENT DOCUMENTS

| | | | | |
|---|---|---|---|---|
| 5,903,068 | A * | 5/1999 | Suzuki | H04R 1/00 29/594 |
| 2004/0091127 | A1* | 5/2004 | Yasuda | H02K 23/04 381/162 |
| 2004/0240702 | A1* | 12/2004 | Kaiwa | H04R 1/06 381/423 |
| 2013/0301396 | A1* | 11/2013 | Kim | H02K 33/18 367/189 |

(Continued)

FOREIGN PATENT DOCUMENTS

| | | | |
|---|---|---|---|
| JP | 2007-129678 | A | 5/2007 |
| KR | 10-2003-0069533 | A | 8/2003 |

(Continued)

*Primary Examiner* — Sean H Nguyen

(74) *Attorney, Agent, or Firm* — LRK Patent Law Firm

(57) ABSTRACT

A sound vibration actuator includes: a casing having an internal space, a coil part coupled to the casing to receive power, a magnet part disposed in the casing, an elastic member whose one surface coupled to the magnet part, a substrate drawn from the internal space, and an external device-coupling part disposed on an outer peripheral surface of the casing to be coupled to an external device, wherein the casing has an underside casing part, a side periphery casing part, and a top casing part, the coil part is coupled to the top casing part, and the external device-coupling part includes a first coupling area coming into contact with a portion of the outer periphery of the side periphery casing part and second coupling areas extended from the first coupling area in a vertical direction to the first coupling area coupled to the external device.

14 Claims, 7 Drawing Sheets

(56) References Cited

U.S. PATENT DOCUMENTS

| | | | | |
|---|---|---|---|---|
| 2015/0181345 | A1* | 6/2015 | Cai | H04R 9/06 381/412 |
| 2016/0100254 | A1* | 4/2016 | Bae | H04R 7/26 381/354 |
| 2018/0250709 | A1* | 9/2018 | Choi | H02K 33/00 |

FOREIGN PATENT DOCUMENTS

| | | | |
|---|---|---|---|
| KR | 10-2004-0096397 | A | 11/2004 |
| KR | 10-2010-0063396 | A | 6/2010 |
| KR | 10-2014-0112166 | A | 9/2014 |
| KR | 10-2018-0010288 | A | 1/2018 |
| KR | 10-1911369 | B1 | 10/2018 |

* cited by examiner (a)

(b)

SOUND VIBRATION ACTUATOR

CROSS REFERENCE TO RELATED APPLICATION

The present application claims the benefit of Korean Patent Application No. 10-2018-0128758 filed in the Korean Intellectual Property Office on Oct. 26, 2018, the entire content of which is incorporated herein by reference.

BACKGROUND OF THE INVENTION

1. Field of the Invention

The present invention relates to a sound vibration actuator, and more particularly, to a sound vibration actuator that is capable of improving a coupling force with an external device, while giving no influence on the motions of internal components thereof.

2. Description of Related Art

Generally, mobile terminals like smartphones have vibration functions (haptic functions) of interfacing call forwarding as well as of interfacing key input, event occurrence, and application execution to a user.)

A vibration motor converting an electromagnetic force into a mechanical driving force is used as a driving device to generate up and down vibrations, and with the trend toward the compactualization of a mobile terminal, a sound vibration actuator, which is capable of generating sounds as well as vibrations, has been developed.

In a process where the sound vibration actuator is vibrated up and down, further, the sound vibration actuator may swing left and right due to the characteristics of an elastic member disposed therein and generation of residual vibrations, and also, the sound vibration actuator may have an amount of vibration larger than a general vibration motor according to characteristics of a casing for making a shape thereof, so that a fixing force to an external device may be weakened.

Because of decrement in the fixing force, if there is a gap between the sound vibration actuator and a device for mounting the sound vibration actuator thereon, the sound vibration actuator fails to generate vibrations in a desired frequency band, and in a process where the internal components of the sound vibration actuator collide against each other, also, problems such as coil disconnection and damage of the elastic member may occur.

Accordingly, there is a need for development of a new sound vibration actuator capable of increasing a coupling force to an external device, while generating vibrations in various frequency bands.

SUMMARY OF THE INVENTION

Accordingly, the present invention has been made in view of the above-mentioned problems occurring in the related art, and it is an object of the present invention to provide a sound vibration actuator that is capable of improving a coupling force to an external device, while giving no influence on the motions of internal components thereof.

It is another object of the present invention to provide a sound vibration actuator that is capable of being stably fixed even to an external device having various shapes.

The technical problems to be achieved through the present invention are not limited as mentioned above, and other technical problems not mentioned herein will be obviously understood by one of ordinary skill in the art through the following description.

To accomplish the above-mentioned objects, according to one aspect of the present invention, there is provided a sound vibration actuator including: a casing having an internal space formed therein; a coil part coupled to the casing in the internal space in such a manner as to receive power from the outside; a magnet part disposed in the internal space of the casing; an elastic member whose one surface coupled to the magnet part; a substrate drawn from the internal space; and an external device-coupling part disposed on an outer peripheral surface of the casing in such a manner as to be coupled to an external device.

According to the present invention, desirably, the casing has an underside casing part, a side periphery casing part, and a top casing part; the coil part is coupled to the top casing part of the internal space; and the underside casing part is fixed to an external sound generator.

According to the present invention, desirably, the external device-coupling part includes a first coupling area coming into close contact with at least a portion of the outer periphery of the side periphery casing part and second coupling areas extended from the first coupling area in a vertical direction to the first coupling area in such a manner as to be coupled to the external device.

According to the present invention, desirably, the external device-coupling part further includes a third coupling area extended from the first coupling area to seat the substrate thereonto.

According to the present invention, desirably, the second coupling areas and the third coupling area are disposed on planes having different heights.

According to the present invention, desirably, the underside of the third coupling area is disposed on the same plane as the underside casing part.

According to the present invention, desirably, the external device-coupling part further includes a fourth coupling area extended from the first coupling area to surround the outer periphery of the top casing part.

According to the present invention, desirably, the second coupling areas, the third coupling area, and the fourth coupling area are disposed on planes having different heights from each other.

According to the present invention, desirably, the external device-coupling part whose one surface is coupled to the underside casing part, and the second coupling areas and the third coupling area are disposed on the same plane as each other.

According to the present invention, desirably, the external device-coupling part is formed unitarily with the underside casing part, and the second coupling areas and the third coupling area are disposed on the same plane as each other.

According to the present invention, desirably, the underside casing part, the side periphery casing part, and the top casing part are made of a magnetic material.

According to the present invention, desirably, the coil part includes a coil for generating an electromagnetic force and a coil yoke for amplifying the electromagnetic force, and the coil yoke is made of a magnetic material.

According to the present invention, desirably, the coil yoke is disposed on top of the coil yoke.

To accomplish the above-mentioned objects, according to another aspect of the present invention, there is provided an external device-coupling part for coupling a sound vibration actuator to an external device, including: a first coupling area adapted to surround at least a portion of an outer periphery of the sound vibration actuator; and second coupling areas extended from the first coupling area in a vertical direction to the first coupling area in such a manner as to be coupled to the external device.

According to the present invention, desirably, each second coupling area has at least one or more holes formed thereon to couple the external device thereto.

According to the present invention, desirably, the external device-coupling part further includes a third coupling area extended from the first coupling area to seat a substrate of the sound vibration actuator thereonto.

According to the present invention, desirably, the underside of the third coupling area is disposed on the same plane as the underside of the sound vibration actuator.

According to the present invention, desirably, the external device-coupling part further includes a fourth coupling area extended from the first coupling area to surround at least a portion of a top periphery of the sound vibration actuator.

According to the present invention, desirably, the second coupling areas, the third coupling area, and the fourth coupling area are disposed on planes having different heights from each other.

BRIEF DESCRIPTION OF THE DRAWINGS

The above and other objects, features and advantages of the present invention will be apparent from the following detailed description of the embodiments of the invention in conjunction with the accompanying drawings, in which.

DETAILED DESCRIPTION OF THE EMBODIMENTS

Figure 1:
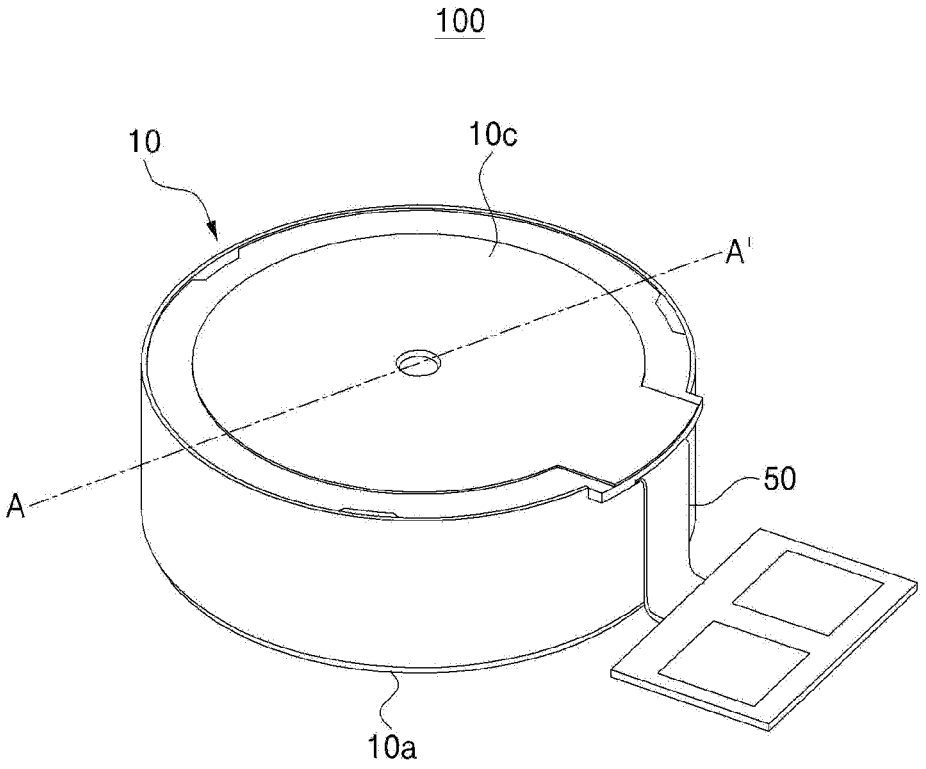
FIG. 1 is a perspective view showing a sound vibration actuator according to first to third embodiments of the present invention, wherein some of components thereof are not shown.

Hereinafter, the present invention will be explained in detail with reference to the attached drawings. In the description, it should be noted that the parts corresponding to those of the drawings are indicated by corresponding reference numerals. Objects, characteristics and advantages of the present invention will be more clearly understood from the detailed description as will be described below and the attached drawings. Before the present invention is disclosed and described, it is to be understood that the disclosed embodiments are merely exemplary of the invention, which can be embodied in various forms.

All terms (including technical or scientific terms) used herein, unless otherwise defined, have the same meanings which are typically understood by those having ordinary skill in the art. The terms, such as ones defined in common dictionaries, should be interpreted as having the same meanings as terms in the context of pertinent technology, and should not be interpreted as having ideal or excessively formal meanings unless clearly defined in the specification. An expression referencing a singular value additionally refers to a corresponding expression of the plural number, unless explicitly limited otherwise by the context.

In this application, terms, such as "comprise", "include", or "have", are intended to designate those characteristics, numbers, steps, operations, elements, or parts which are described in the specification, or any combination of them that exist, and it should be understood that they do not preclude the possibility of the existence or possible addition of one or more additional characteristics, numbers, steps, operations, elements, or parts, or combinations thereof.

FIG. 1 is a perspective view showing a sound vibration actuator according to first to third embodiments of the present invention, wherein some of components thereof are not shown.

As shown in FIG. 1, the sound vibration actuator 100 has a shape of a cylinder and is configured to have a substrate 50 exposed outward from a casing 20. In this case, the sound vibration actuator 100 is a device for generating vibrations caused by an electromagnetic force between internal components thereof and sounds caused from the vibrations, while receiving power for generating the vibrations from the substrate 50 exposed outward therefrom.

So as to supply the power to the sound vibration actuator 100, like this, the substrate 50 is drawn from a top casing part 10*c* of the casing 10, is extended along a side periphery of the casing 10, and is then bent to the plane on which an underside casing part 10*a* of the casing 10 is located. In this case, the substrate 50 is constituted of a thin flexible printed circuit (FPC) board.

Further, the sound vibration actuator 100 has an external device-coupling part 60 disposed on the outer periphery of the casing 10 to stably seat the substrate 50 thereonto and to firmly fix the sound vibration actuator 100 to an external device, while being vibrated. First, an explanation on the external device-coupling part 60 of the sound vibration actuator 100 according to the present invention will be given later after the internal components of the sound vibration actuator 100 are described.

Figure 2:
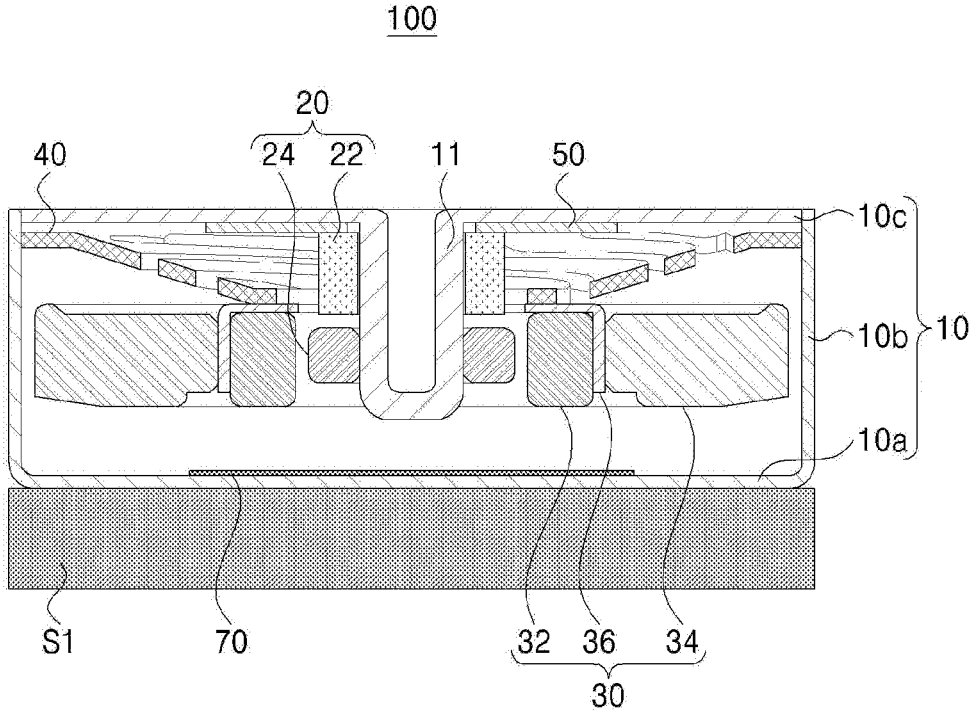
FIG. 2 is a sectional view taken along the line A-A' of the sound vibration actuator of FIG. 1.

FIG. 2 is a sectional view taken along the line A-A' of the sound vibration actuator of FIG. 1.

As shown in FIG. 2, the sound vibration actuator 100 includes a casing 10, a coil part 20, a magnet part 30, an elastic member 40 and a substrate 50.

First, the casing 10 has a space formed therein to accommodate the casing 10, the coil part 20, the magnet part 30, the elastic member 40 and the substrate 50 therein.

The casing 10 is constituted of an underside casing part 10*a*, a side periphery casing part 10*b*, and a top casing part 10*c* that are coupled to each other by means of caulking, bonding or welding.

The top casing part 10*c* has a protrusion 11 formed at the center thereof so as to seat the coil part 20 thereonto. The protrusion 11, which has a hollow shape protruding inward from the center of the top casing part 10*c*, can be very easily formed by means of press or deep drawing. If the protrusion 11 has such a hollow shape, advantageously, manufacturing and coupling processes can be simple, a weight of the sound vibration actuator 100 can be reduced, a variety of magnetic materials can be inserted later into the hollow portion of the protrusion 11 from the outside to adjust the amount of magnetic flux.

The top casing part 10*c* may be an acoustic diaphragm, and accordingly, the coil part 20 is vibrated by an electromagnetic force generated between the magnet part 30 and itself, thereby generating sounds.

The side periphery casing part 10*b* is provided to the same shape as the outer peripheries of the top casing part 10*c* and the underside casing part 10*a*. According to the present invention, the side periphery casing part 10*b* has a shape of a cylinder, but without being limited thereto, of course, it may have a sectional shape of a square or polygon according to shapes of the top casing part 10*c* and the underside casing part 10*a*. Also, the elastic member 40 disposed in the internal space of the casing 10 has the same sectional shape as the square or polygonal side periphery casing part 10*b*.

The underside casing part 10*a* can be fixed to the external sound generator S. To do this, the underside casing part 10*a* has an adhesive member disposed on one surface thereof, and otherwise, it has fixing holes (not shown) punched thereon. The external sound generator S includes various kinds of mechanisms for generating sounds, for example, a display module.

Only the underside casing part 10*a* is fixed to the external sound generator S, and other parts are not fixed to any external devices, so that if power is supplied to the sound vibration actuator 100, the coil part 20 disposed at the inner surface of the top casing part 10*c* is vibrated to allow the external sound generator s connected to the sound vibration actuator 100 to generate vibrations in the range of a high frequency band. In more detail, if the coil part 20 vibrates, vibrations with a high center resonance frequency of 5000~7000 Hz as well as with a low center resonance frequency of 100 Hz generated by the vibration of the magnet part 30 can be generated.

As the sound vibration actuator 100 thereby can generate vibrations in the range of a high frequency band, if the sound vibration actuator 100 is built in a mobile terminal, not only vibrations can be generated on the display surface of the terminal, but also sounds can be generated from a display surface, without any use of a receiver on the mobile terminal, thereby maximizing the use of the display surface in the mobile terminal.

Further, the casing 10 having the underside casing part 10*a*, the side periphery casing part 10*b*, and the top casing part 10*c* is made of a magnetic material so as to maximize a magnetic field generated from the coil part 20 and the magnet part 30 disposed therein. Accordingly, the underside casing part 10*a*, the side periphery casing part 10*b*, and the top casing part 10*c* are made of the same magnetic material as each other, and otherwise, they may be made of different magnetic materials from each other according to a user's selection.

Next, the coil part 20 has a coil 22 and a coil yoke 24. In this case, the coil 22 and the coil yoke 24 are coupled to top of the casing 10, that is, the top casing part 10*c*, and since only the outer periphery of the top casing part 10*c* is fixed to the side periphery casing part 10*b*, the remaining region thereof is not fixed to any component, so that in a process where the coil 22 and the coil yoke 24 are vibrated, the top casing part 10*c* can be vibrated together.

Meanwhile, the coil 22 of the coil part 20 may be a sound coil that generates magnetic fields having different directions and strengths. In more detail, if an alternating current is applied to the coil 22, an alternating magnetic field is generated from the coil 22, so that the top casing part 10*c* coming into contact with the coil 22 is vibrated to a signal in an audible frequency range, thereby generating sounds.

The coil 22 and the coil yoke 24 of the coil part 20 are fitted to the protrusion 11 of the top casing part 10*c*, and the coil 22 is disposed on top of the coil yoke 24. Also, the coil 22 and the coil yoke 24 have a shape of a ring, but without being limited thereto, of course, they may have various shapes fitted to the protrusions 11.

The coil yoke 24 of the coil part 20 is fittedly disposed on the outer peripheral surface of the protrusion 11 in parallel with the coil 22, is made of a magnetic material, and serves to amplify the electromagnetic force generated from the coil 22.

In the process where the coil part 20 is vibrated according to an induced electromagnetic force generated from the coil 22 and the coil yoke 24, if the electromagnetic force corresponding to a resonance frequency of the magnet part 30 disposed parallel to the coil part 20 is generated, the magnet part 30 can be operated.

The magnet part 30 is located around the coil 22 and includes a magnet 32, a weight 34, and a yoke 36. If the alternating current is applied to the coil 22 of the coil part 20, the magnet part 30 can be operated differently in variance with the magnitude of the alternating current.

The magnet 32 of the magnet part 30 is disposed around the coil yoke 24 and can vibrates up and down cooperating with the alternating magnetic field generated from the coil 22. Though the magnet 32 is one in FIG. 2, it may include two or more magnets coupled to each other. If the two or more magnets are coupled to each other, the electromagnetic force can be stronger than that generated from one magnet.

Meanwhile, a magnetic fluid (not shown) can be applied to one of the side surfaces of the magnet 32 or the coil yoke 24 to prevent direct contact between them, thereby suppressing the noise or damage caused by direct collision between them. Further, because of its viscosity, the magnetic fluid can help the magnet 32 stop vibration more quickly after turning off the power.

The weight 34 of the magnet part 30 is disposed around the magnet 32 and serves to amplify the up and down vibrations of the magnet 32 by means of its self weight. Further, an outer diameter of the weight 34 is smaller than an inner diameter of the side periphery casing part 10*b*, so that in a process where the entire magnet part 30 is vibrated up and down, the contact of the magnet part 30 with the side periphery casing part 10*b* is prevented to ensure the reliability of the sound vibration actuator 100.

The yoke 36 of the magnet part 30 is disposed between the magnet 32 and the weight 34, and serves to form a closed magnetic circuit capable of allowing the magnetic field generated from the magnet 32 to gently flow.

The elastic member 40 is disposed on the top casing part 10*c* to support the magnet part 30. The elastic member 40 is decreased in diameter as it goes from the outer peripheral to the inner center and protruded downward direction. The inner surface part of the elastic member 40 is fixed to the magnet part 30, and the outer surface thereof is coupled to the top casing part 10*c*.

The elastic member 40 serves not only to support the magnet part 30, but also to amplify the up and down vibrations of the magnet part 30 by means of the given elasticity thereof. The elastic member 40 can be made of some magnetic materials.

On the other hand, the elastic member 40 may come into contact with the underside casing part 10*a*, not with the top casing part 10*c*, so as to support the magnet part 30. In this case, an inner center of the elastic member 40 comes into contact with the magnet part 30, and an outer periphery thereof comes into contact with the underside casing part 10*a*.

If the elastic member 40 is coupled to the top casing part 10*c* or the underside casing part 10*a* by means of welding, it can have a high fixing force so that a desired resonance frequency can be more accurately set.

Next, the substrate 50 is a thin FPC board disposed on the underside of the top casing part 10*c* in such a manner as to allow a portion thereof to be exposed outward from the space formed by the side periphery casing part 10*b* to supply power to the coil 22. In more detail, the substrate 50 has a hole formed at the center thereof, and the hole has the same diameter as the protrusion 11, so that the substrate 50 can be disposed on the underside of the top casing part 10*c*. Also, the substrate 50 comes into direct contact with the coil 22. Further, the substrate 50 is drawn from the internal space formed by the top casing part 10*c* in such a manner as to be extended downward along the side periphery casing part 10*b* and to allow the end thereof to be bent at the location of the underside casing part 10*a* in parallel to the casing 10, so that it can receive the power from the outside.

Lastly, the sound vibration actuator 100 includes a buffering member 60 adapted to prevent the casing 10 from being damaged due to the vibrations of the coil part 20 and the magnet part 30 in the internal space thereof. In detail, the buffering member 60 is disposed on the underside casing part 10*a* to reduce noise due to vibrations and to prevent the external sound generator S from being damaged due to vibration impacts or to prevent loss in amount of vibration.

The buffering member 60 may have a circle shape like the underside casing part 10*a* or a ring shape like the magnet part 40, but not limited thereto.

Up to now, an explanation on the internal structure of the sound vibration actuator 100 according to the various embodiments of the present invention has been given. According to the present invention, as the coil part 20 and the magnet part 30 of the sound vibration actuator 100 generate without being fixed to the case 10, the sound vibration actuator 100 can generate sounds in the range of the low frequency band to the high frequency band. Accordingly, the sound vibration actuator 100 can be applied to various fields.

Hereinafter, the external device-coupling part 60 which serves to stably fix the sound vibration actuator 100 to the external device will be explained.

Figure 3:
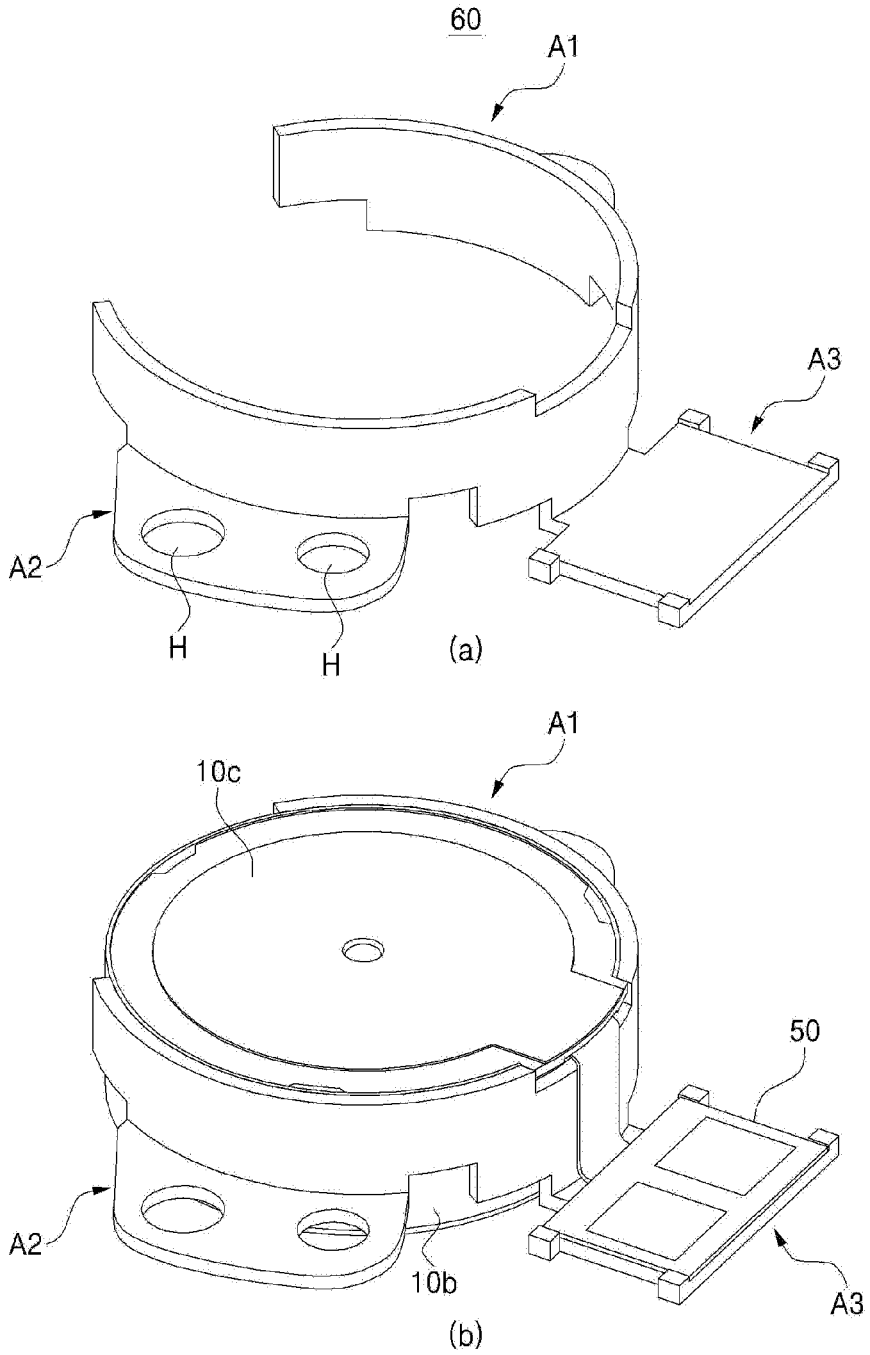
FIG. 3 is perspective views showing the sound vibration actuator according to the first embodiment of the present invention.
Figure 4:
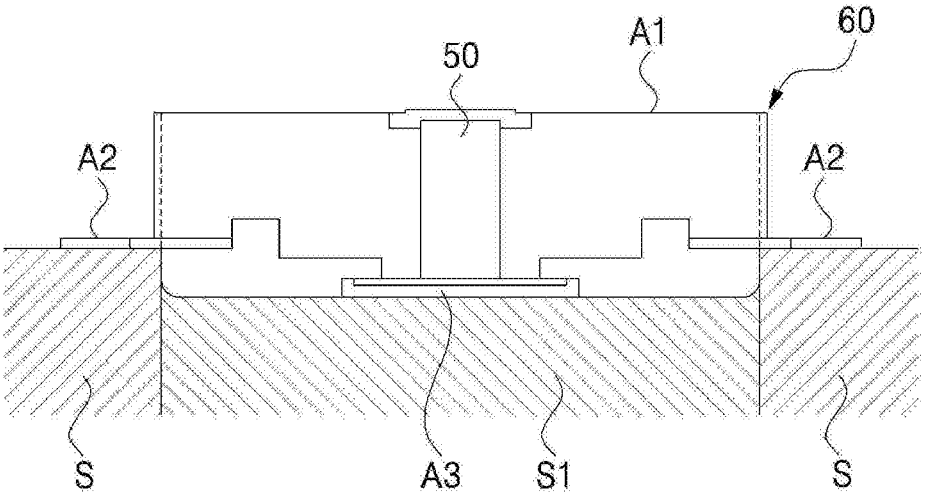
FIG. 4 is a front view showing the sound vibration actuator according to the first embodiment of the present invention.

FIG. 3 is perspective views showing the sound vibration actuator according to the first embodiment of the present invention, and FIG. 4 is a front view showing the sound vibration actuator according to the first embodiment of the present invention.

FIG. 3 shows the external device-coupling part 60 and the external device-coupling part 60 fitted to the outer periphery of the sound vibration actuator 100. In detail, the external device-coupling part 60 has a first coupling area A1 having the same shape as the side periphery casing part 10*b* so that it can be coupled to the sound vibration actuator 100. Moreover, the first coupling area A1 has a shape of a circle surrounding the whole side periphery casing part 10*b*, but so as to reduce a gap between the side periphery casing part 10*b* and the external device-coupling part 60, of course, it may have a shape of an arch surrounding only a portion of the side periphery casing part 10*b*.

Further, the external device-coupling part 60 has second coupling areas A2 extended from the first coupling area A1 in a vertical direction to the first coupling area A1 in such a manner as to be coupled to the external device S and a third coupling area A3 extended from the first coupling area A1 to seat the substrate 50 thereonto.

Referring to FIG. 4, the external device-coupling part 60 has the second coupling areas A2 adapted to fix the sound vibration actuator 100 to the external device having various structures. The second coupling areas A2 of the external device-coupling part 60 can be fixed to the external device S, and the third coupling area A3 of the external device-coupling part 60 and the underside of the underside casing part 10*a* are fixed to an external sound generator S1. In detail, the underside of the third coupling area A3 of the external device-coupling part 60 is located on the same plane as the underside casing part 10*a*. Under the above-mentioned configuration, for example, the sound vibration actuator 100 is mounted onto a mobile terminal, and in this case, if the mobile terminal is vibrated up and down in a state of being inclined, the internal components of the sound vibration actuator 100 can be vibrated, without any fluctuation.

Otherwise, the second coupling areas A2 of the external device-coupling part 60 are located on the same plane as the third coupling area A3 on which the substrate 50 is seated to increase a coupling force between the external sound generator S1 and the sound vibration actuator 100 and to suppress left/right vibrations of the sound vibration actuator 100.

Also, as shown in FIG. 3, each second coupling area A2 of the external device-coupling part 60 has two holes H formed thereon, but without being limited thereto, it may have one hole or a plurality of holes H. Of course, it may be fixed to the external device S by means of bonding, laser welding, and so on, without having any hole H.

Figure 5:
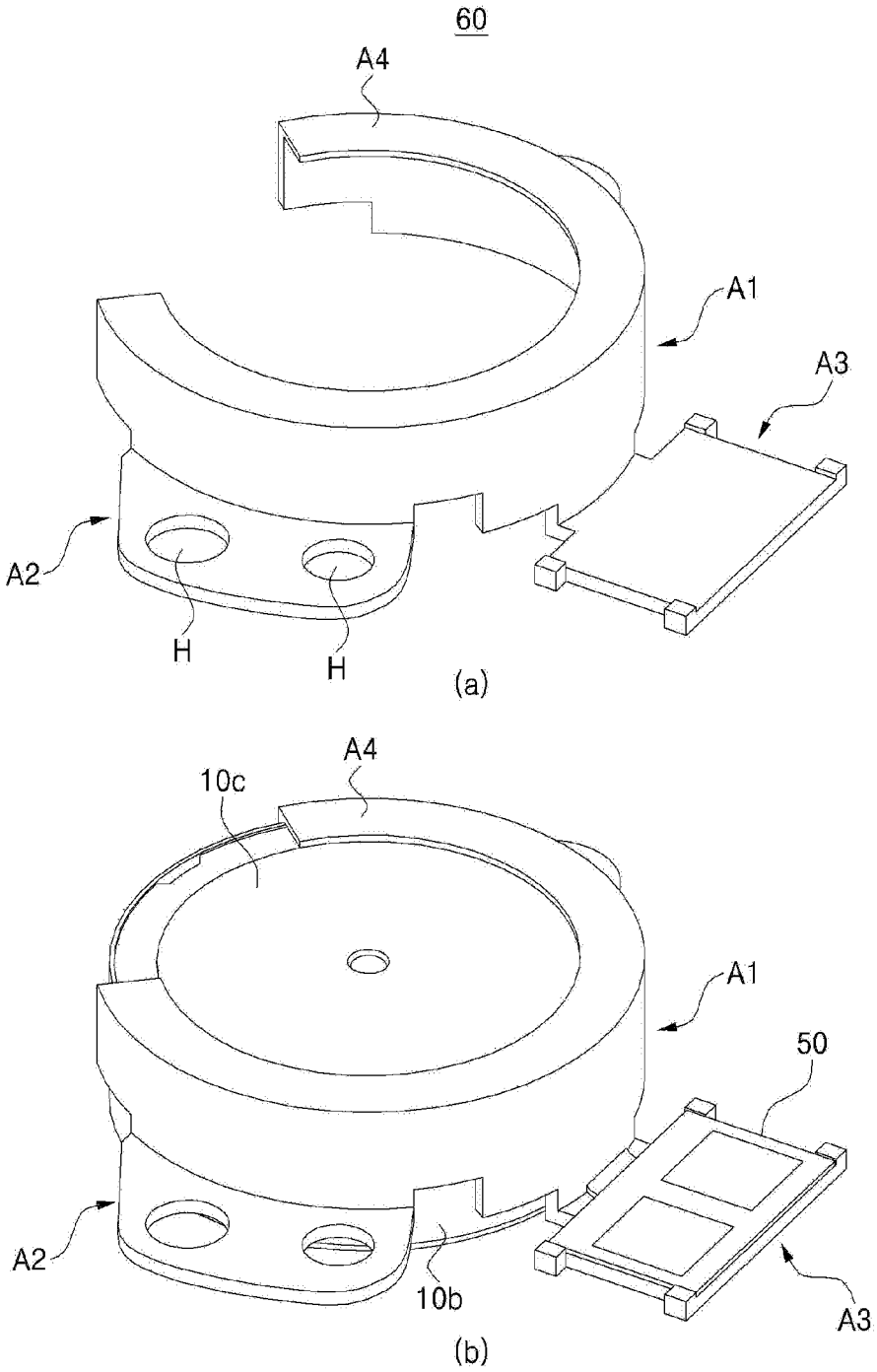
FIG. 5 is perspective views showing the sound vibration actuator according to the second embodiment of the present invention.
Figure 6:
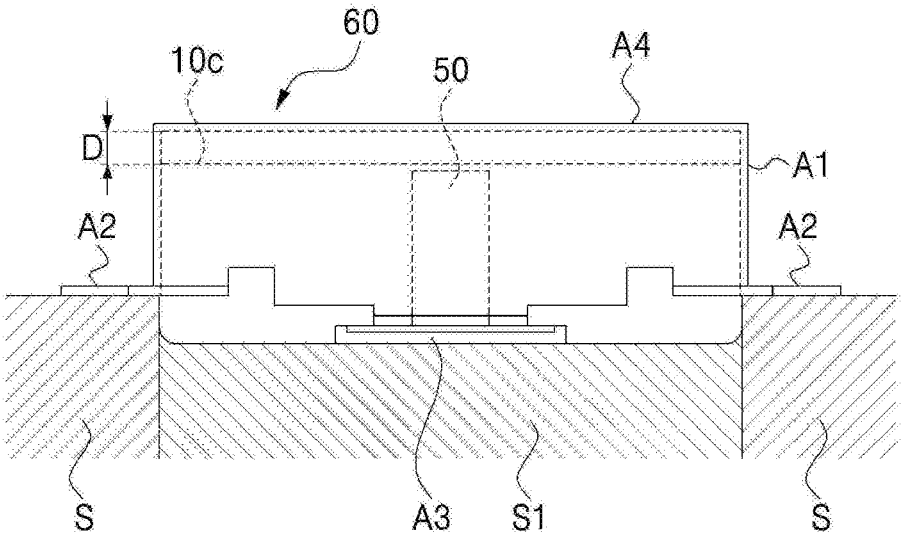
FIG. 6 is a front view showing the sound vibration actuator according to the second embodiment of the present invention.

FIG. 5 is perspective views showing the sound vibration actuator according to the second embodiment of the present invention, and FIG. 6 is a front view showing the sound vibration actuator according to the second embodiment of the present invention.

In addition to the first to third areas A1 to A3 of the external device-coupling part 60, as shown in FIG. 5, an external device-coupling part 60 of the sound vibration actuator 100 according to the second embodiment of the present invention further includes an additional area adapted to couple the sound vibration actuator 100 to the external device S more firmly. In detail, the external device-coupling part 60 has a fourth coupling area A4 extended from the first coupling area A1 to surround an outer periphery of the top casing part 10*c*. In the same manner as the first coupling area A1, further, the fourth coupling area A4 has a shape of an arch surrounding only a portion of the top casing part 10*c*.

Referring next to FIG. 6, the fourth coupling area A4 of the external device-coupling part 60 and the top casing part 10*c* are spaced apart from each other by a given distance D, without coming into direct contact with each other, so as to prevent the vibration of the top casing part 10*c* from being inhibited by the vibration of the coil part 20. In this case, the given distance D is determined in consideration of an up-and-down vibration width of the top casing part 10*c* vibrated by the coil part 20.

Moreover, the second coupling areas A2, the third coupling area A3 and the fourth coupling area A4 of the external device-coupling part 60 are disposed parallel to each other to different heights from each other, and as they are coupled to the remaining casing parts except the top casing part 10*c* of the sound vibration actuator 100, vibration modes, that is, various resonance frequency bands of the sound vibration actuator 100 can be maintained to generate sounds caused thereby.

Figure 7:
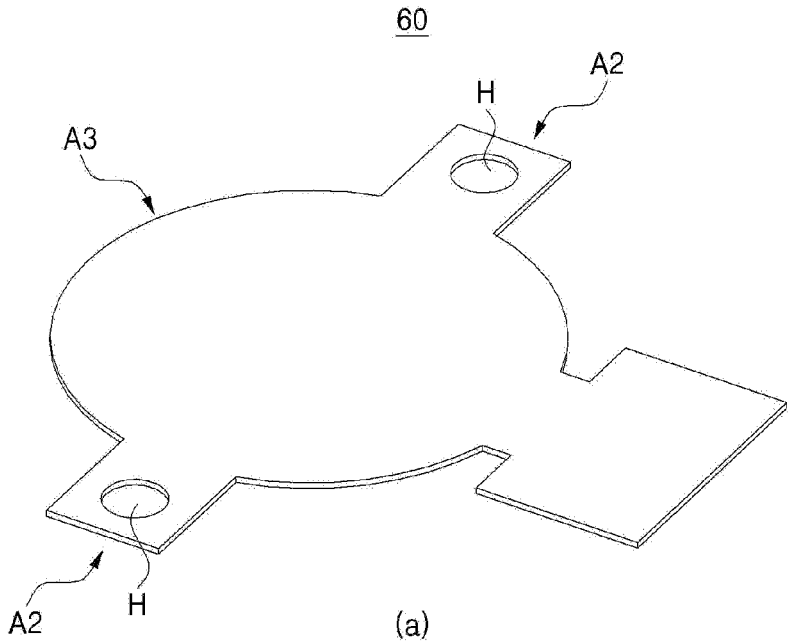
FIG. 7 is perspective views showing the sound vibration actuator according to the third embodiment of the present invention.
Figure 7:
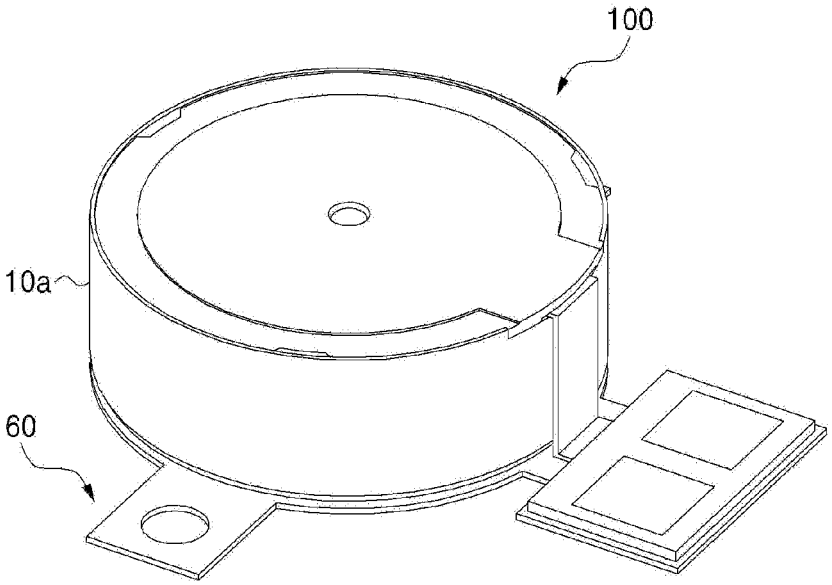

FIG. 7 is perspective views showing the sound vibration actuator 100 according to the third embodiment of the present invention.

As shown in FIG. 7, an external device-coupling part 60 of the sound vibration actuator 100 according to the third embodiment of the present invention has a shape of a plate coupled to the underside casing part 10*a* in such a manner as to be fixed to the external sound generator S1. In detail, the external device-coupling part 60 includes a third coupling area A3 for seating the substrate 50 thereonto and second coupling areas A2 fixed to the external sound generator S1, without having a first coupling area A1 for surrounding the side periphery casing part 10*b*, thereby saving a manufacturing cost for the sound vibration actuator 100 whose coupling force is increased and also easily making the sound vibration actuator 100.

Further, the external device-coupling part 60 can be formed unitarily with the underside casing part 10*a*, so that the whole thickness can be reduced to make the sound vibration actuator 100 compacted.

Up to now, the external device-coupling parts 60 of the sound vibration actuators 100 according to the first to third embodiments of the present invention have been explained. According to the present invention, the sound vibration actuator 100 is coupled to the external device S by means of the internal components thereof as well as the external device-coupling part 60, thereby preventing an escape thereof in the process of vibration and ensuring high reliability thereof. Further, the fixing force of the sound vibration actuator 100 to the external device S is increased, without giving a bad influence on an amount of vibration in the sound vibration actuator 100, so that the sound vibration actuator 100 is maintained in various resonance frequency bands.

As described above, the sound vibration actuator according to the present invention can be stably fixed to the external device having various shapes, thereby ensuring high reliability.

In addition, the sound vibration actuator according to the present invention can maintain an amount of vibration because no internal components thereof are used to couple the sound vibration actuator to the external device.

Further, the sound vibration actuator according to the present invention can generate vibrations in various frequency bands because the coil part and the magnet part are not fixed thereto in the process where the vibrations are generated.

Furthermore, the sound vibration actuator according to the present invention can suppress left/right vibrations from being generated finely in a process where vibrations are generated, thereby constantly maintaining an amount of up-and-down vibration thereof.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A sound vibration actuator comprising:

a casing (10) having an internal space formed therein;

a coil part (20) coupled to the casing (10) in the internal space in such a manner as to receive power from the outside;

a magnet part (30) disposed in the internal space of the casing (10);

an elastic member (40) whose one surface coupled to the magnet part (30);

a substrate (50) drawn from the internal space; and an external device-coupling part (60) disposed on an outer peripheral surface of the casing (10) in such a manner as to be coupled to an external device (S), wherein the casing (10) has an underside casing part (10*a*), a side periphery casing part (10*b*), and a top casing part (10*c*); the coil part (20) is coupled to the top casing part (10*c*) of the internal space; and the external device-coupling part (60) comprises a first coupling area (A1) coming into close contact with at least a portion of the outer periphery of the side periphery casing part (10*b*) and second coupling areas (A2) extended from the first coupling area (A1) in a vertical direction to the first coupling area (A1) in such a manner as to be coupled to the external device (S).

2. The sound vibration actuator according to claim 1, wherein the underside casing part (10*a*) is fixed to an external sound generator (S1).

3. The sound vibration actuator according to claim 1, wherein the external device-coupling part (60) further comprises a third coupling area (A3) extended from the first coupling area (A1) to seat the substrate (50) thereonto.

4. The sound vibration actuator according to claim 3, wherein the second coupling areas (A2) and the third coupling area (A3) are disposed on planes having different heights from each other.

5. The sound vibration actuator according to claim 3, wherein the underside of the third coupling area (A3) is disposed on the same plane as the underside casing part (10*a*).

6. The sound vibration actuator according to claim 3, wherein the external device-coupling part (60) further comprises a fourth coupling area (A4) extended from the first coupling area (A1) to surround the outer periphery of the top casing part (10*c*).

7. The sound vibration actuator according to claim 6, wherein the second coupling areas (A2), the third coupling area (A3), and the fourth coupling area (A4) are disposed on planes having different heights from each other.

8. The sound vibration actuator according to claim 3, wherein the external device-coupling part (60) whose one surface is coupled to the underside casing part (10*a*), and the second coupling areas (A2) and the third coupling area (A3) are disposed on the same plane as each other.

9. The sound vibration actuator according to claim 3, wherein the external device-coupling part (60) is formed unitarily with the underside casing part (10*a*), and the second coupling areas (A2) and the third coupling area (A3) are disposed on the same plane as each other.

10. An external device-coupling part for coupling a sound vibration actuator (100) to an external device (S), comprising:

a first coupling area (A1) adapted to surround at least a portion of an outer periphery of the sound vibration actuator (100);

second coupling areas (A2) extended from the first coupling area (A1) in a vertical direction to the first coupling area (A1) in such a manner as to be coupled to the external device (S); and a third coupling area (A3) extended from the first coupling area (A1) to seat a substrate (50) of the sound vibration actuator (100) thereonto.

11. The external device-coupling part according to claim 10, wherein each second coupling area (A2) has at least one or more holes (H) formed thereon to couple the external device (S) thereto.

12. The external device-coupling part according to claim 10, wherein the underside of the third coupling area (A3) is disposed on the same plane as the underside of the sound vibration actuator (100).

13. The external device-coupling part according to claim 10, further comprising a fourth coupling area (A4) extended from the first coupling area (A1) to surround at least a portion of a top periphery of the sound vibration actuator (100).

14. The external device-coupling part according to claim 13, wherein the second coupling areas (A2), the third coupling area (A3), and the fourth coupling area (A4) are disposed on planes having different heights from each other.

* * * * *